United States Patent [19]

Shaw et al.

[11] Patent Number: 4,460,459

[45] Date of Patent: Jul. 17, 1984

[54] SEQUENTIAL FLOTATION OF SULFIDE ORES

[75] Inventors: Douglas R. Shaw; John F. Spisak, both of Arvada; Jerome P. Downey, Parker; Gary E. Butts, Arvada, all of Colo.

[73] Assignee: Anschutz Mining Corporation, Denver, Colo.

[21] Appl. No.: 466,837

[22] Filed: Feb. 16, 1983

[51] Int. Cl.[3] ..... B03B 1/00

[52] U.S. Cl. ..... 209/9; 209/167; 252/61; 75/2

[58] Field of Search ..... 209/166, 167, 4, 9; 241/11; 252/61; 75/2

[56] References Cited

U.S. PATENT DOCUMENTS

| | | | |
|---|---|---|---|
| 2,399,845 | 5/1946 | Allen et al. | 209/167 |
| 3,309,029 | 3/1967 | Frame | 209/166 |
| 4,283,017 | 8/1981 | Coale et al. | 209/167 |
| 4,351,668 | 9/1982 | Stephenson et al. | 75/2 |
| 4,387,034 | 6/1983 | Unger et al. | 209/166 |

FOREIGN PATENT DOCUMENTS

| | | | |
|---|---|---|---|
| 54-26482 | 9/1979 | Japan | 209/167 |
| 711887 | 3/1971 | South Africa . | |

*Primary Examiner*—Bernard Nozick

*Attorney, Agent, or Firm*—Holman & Stern

[57] ABSTRACT

A sequential flotation process for the recovery of high-grade concentrates of copper, lead and cobalt-nickel from sulfide ores is provided. A primary grind ore pulp is conditioned with $SO_2$ as $H_2SO_3$ under intense aeration, and the conditioned pulp subjected to sequential flotation, with regrinding and conditioning of a copper rougher concentrate obtained in the first flotation step for copper.

13 Claims, 1 Drawing Figure

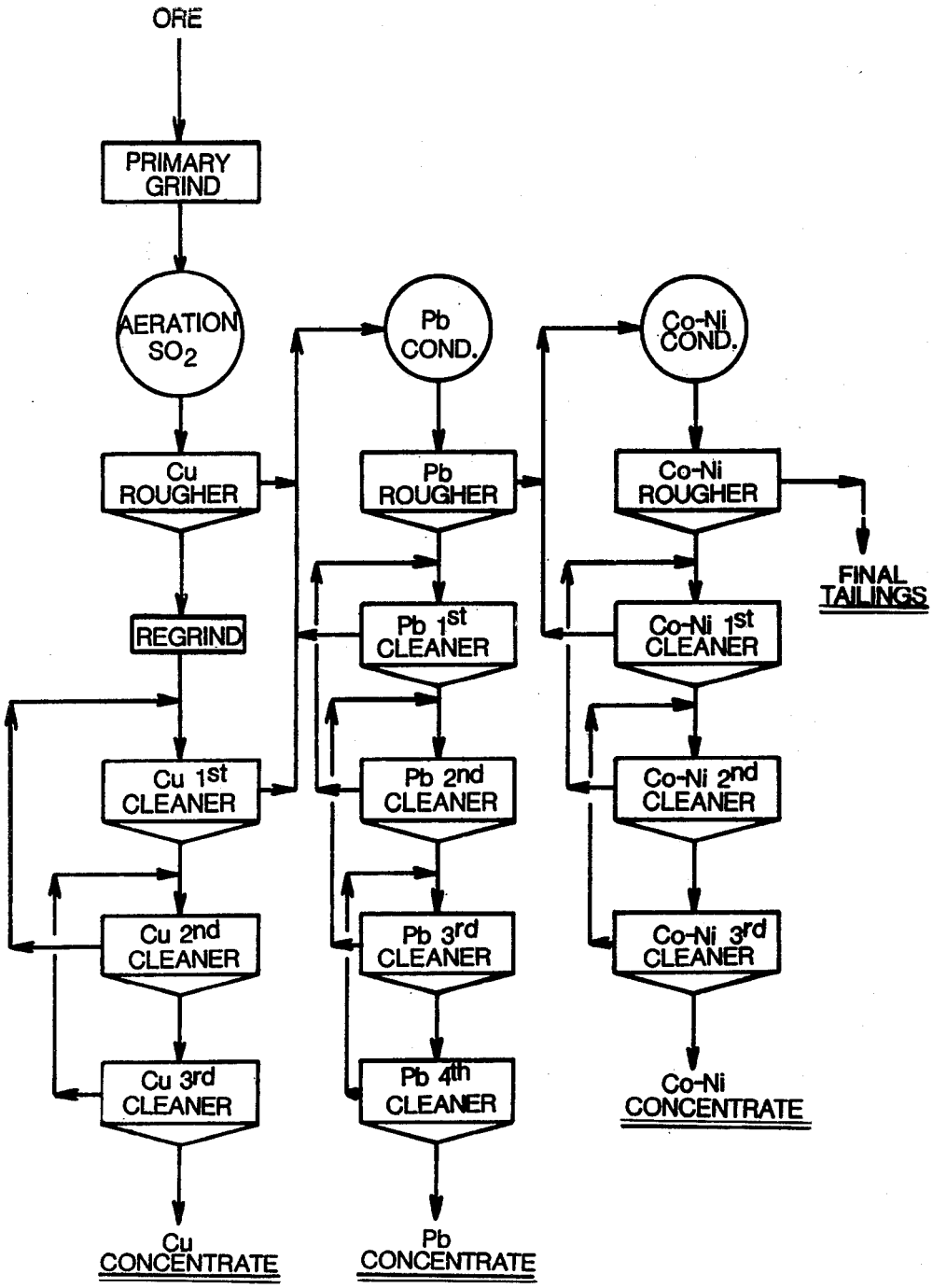
ORE
PRIMARY GRIND
AERATION $SO_2$
Pb COND.
Co-Ni COND.
Cu ROUGHER
Pb ROUGHER
Co-Ni ROUGHER
FINAL TAILINGS
REGRIND
Pb 1st CLEANER
Co-Ni 1st CLEANER
Cu 1st CLEANER
Pb 2nd CLEANER
Co-Ni 2nd CLEANER
Cu 2nd CLEANER
Pb 3rd CLEANER
Co-Ni 3rd CLEANER
Cu 3rd CLEANER
Pb 4th CLEANER
Co-Ni CONCENTRATE
Cu CONCENTRATE
Pb CONCENTRATE

SEQUENTIAL FLOTATION OF SULFIDE ORES

BACKGROUND OF THE INVENTION

Sulfide ores of the type common to the lead belt areas of southeastern Missouri typically have a valuable mineral content of copper, lead and cobalt-nickel. Characteristically, much of the cobalt-nickel content is lost in the conventional treatment of these ores for recovery of the copper and lead content, and cobalt-nickel is mainly recovered as a low-yield by-product.

The sequential flotation method of the invention applied to such ores permits the recovery of high-yield concentrates of copper, lead and cobalt-nickel. While various selective flotation methods have been applied to complex ores containing copper, lead and zinc mineral suites, with successful recovery of zinc, these ores are mineralogically very distinct from the ore starting material of the present invention, and the prior art has not succeeded in the practical application of sequential flotation to the subject sulfide ores.

SUMMARY OF THE INVENTION

The invention provides a sequential flotation process for the primary recovery of high-grade concentrates of copper, lead and cobalt-nickel from sulfide ores of the type common to the Missouri lead belt area of North America. Concentrates of copper, lead and combined cobalt and nickel are separately recovered in that order by the chemical control and manipulation of the flotation rates of the copper, lead, cobalt-nickel and iron sulfide minerals present in the ore in a conventional sequential flotation system comprising a main flotation circuit for each of the product concentrates. Broadly, according to the process, ground ore pulp is conditioned with sulfur dioxide and intensely aerated prior to copper flotation; the copper rougher concentrate from the copper flotation circuit is relatively finely reground and conditioned with sulfur dioxide prior to cleaning. Preferably, the main copper circuit tailings are routed to the lead and cobalt-nickel flotation circuits in an open-circuit manner.

BRIEF DESCRIPTION OF THE DRAWING

The sole FIGURE is a flowsheet of a continuous sequential flotation process according to the invention.

DETAILED DESCRIPTION OF THE INVENTION

The process of the invention is specifically directed to the recovery of separate concentrates of copper, lead and cobalt-nickel from siegenite-bearing ores of the type common to deposits broadly classified as Mississippi Valley-type deposits. The ores are characterized by sulfide mineral suites typically occurring as siegenite or linnaeite (cobalt-nickel) with chalcopyrite (Cu), galena (Pb), and usually marcasite (Fe), in a carbonate matrix such as dolomite or calcite, and are exemplified by the siegenite-bearing ores of southeastern Missouri and the viburnam trend ore bodies of the new lead belt.

The ore starting material of the present process is ground to sufficiently liberate sulfide minerals for subsequent flotation. In general, a primary grind fineness (ball mill) of from about 65% to about 75% passing 200 mesh (Tyler) is suitable; however, the ease of sulfide liberation with relatively coarse grinding may permit the use of a primary grind product of 60% or less passing 200 mesh, depending on the ore characteristics. The flotation characteristics of the primary grind product are also dependent upon the grinding medium employed, and the fineness of the grind is accordingly adjusted to autogenous, semi-autogenous, pebble or other milling procedures, as necessary.

After grinding, the primary grind pulp is conditioned to depress lead, iron and cobalt-nickel sulfides by addition of sulfur dioxide, preferably in the form of sulfurous acid, and aerated to enhance the promotion and flotation rate of copper. Preferably, $SO_2$ is added in an amount of from about 1 to about 5 lbs $SO_2$ per ton of pulp; the amount will vary, however, depending on the flotation conditions and characteristics of the flotation pulp. If natural air is employed, aeration at a rate of about 3 to 5 cu ft/min per cubic foot of pulp generally will satisfactorily promote copper. Generally, the pulp is aerated substantially concurrently with $SO_2$ addition, although the sequence of $SO_2$ addition and aeration may be varied within broad limits with satisfactory results, depending on actual conditions.

The conditioned pulp is then routed to a flotation system of the type schematically illustrated in the sole Figure, comprising three main flotation circuits for recovery of copper, lead and cobalt-nickel, respectively. (Generally, the recovery of iron present in the subject ore bodies is not economically feasible.) Each of the circuits includes successive concentration and separation stages comprising a roughing stage wherein a rougher concentrate is recovered, and a plurality of cleaning stages, wherein the rougher concentrate is up-graded. Tailing products from each of the circuits are routed to the next circuit for additional mineral recovery.

Flotation of copper is effected in the copper flotation circuit at a slightly acidic pulp pH of about 6.5 to 6.8, the pH being governed by the quantity of sulfur dioxide ($SO_2$) used during conditioning and aeration. A collector selective for copper in an acidic medium is employed, such as ethyl isopropyl thionocarbamate. The pulp is frothed for a period of time which maximizes copper recovery with minimal misplacement of lead or cobalt-nickel; typically, froth times of two to four minutes are adequate. The copper rougher concentrate is then collected, and the copper rougher tailing product is routed to the lead flotation circuit.

The copper rougher concentrate is finely reground prior to cleaning to further liberate cobalt-nickel minerals present and improve their rejection (see Table 1). While regrinding does not generally affect lead recovery, the rougher concentrate should not be reground so finely that the flotation properties of copper are adversely affected. In general, regrinding power requirements of 10 kwhr/ton to about 50 kwhr/ton, preferably from about 20 to 30 kwhr/ton are suitable. The regound concentrate is then conditioned with $SO_2$, again advantageously as sulfurous acid, to depress liberated cobalt-nickel sulfides, usually in amounts of from about 0.05 lbs. to about 1.5 lbs. $SO_2$ per ton of reground pulp. The reground concentrate is then cleaned in a conventional way, for example, by addition of collector $SO_2$ and sodium dichromate. Preferably, the first copper cleaner tailings are combined with the copper rougher tailing product and routed to the lead flotation circuit, rather than recycling the cleaner tailings to the copper rougher as is customary, as this promotes better lead and cobalt-nickel recovery. The copper cleaner product is cleaned one or more times, as desired, and a high-purity copper concentrate, typically containing in excess of 85% of original copper values, is recovered.

TABLE 1

| | Cu Regrind, kwhr/ton | Copper Concentrate Assay, % Cu | Pb | Co | Distribution, % Pb | Co |
|---|---|---|---|---|---|---|
| Sample 2 | 0 | 28 | 3.4 | 0.57 | 7.5 | 10.0 |
| | 30 | 31 | 6.5 | 0.18 | 11.7 | 2.1 |
| Sample 3 | 0 | 26 | 4.1 | 0.55 | 9.4 | 12.9 |
| | 14 | 31 | 4.3 | 0.34 | 8.8 | 7.4 |
| | 29 | 30 | 4.5 | 0.15 | 7.8 | 2.9 |
| Sample 5 | 8[1] | 25 | 5.0 | 0.15 | 18.5 | 5.9 |
| | 13 | 32 | 2.2 | 0.31 | 8.6 | 3.4 |

[1]A comparative test without a copper circuit regrind was not conducted on this sample.

Lead and cobalt-nickel are recovered as concentrates from the respective flotation circuits in conventional fashion. In an exemplary embodiment, lead is recovered by flotation after adjustment of the pH of the pulp to about 8.5 to 9 and after depression of the cobalt-nickel sulfides present by addition of sodium cyanide in an amount of from about 0.25 to 0.375 lb/ton, followed by collector addition and frothing for about 3 to 5 minutes. (While greater amounts of cyanide tend to improve cobalt-nickel rejection in the lead circuit, they also tend to severely depress cobalt-nickel and interfere with subsequent flotation.) Similarly, cobalt-nickel is recoverable by flotation after addition of copper sulfate, which activates cobalt-nickel and complexes with excess cyanide present. After a cobalt-nickel rougher froth time of about 8 minutes or more to maximize cobalt-nickel recovery, the cobalt-nickel rougher concentrate is recovered and cleaned to provide a high-purity cobalt-nickel concentrate containing up to about 92% of the values originally present.

Numerous variations within the scope of the invention will be apparent. Sulfur dioxide, a strong reducing agent, is a key reagent, providing selectivity control throughout the system. In the highly reduced environment provided by $SO_2$, intense aeration depresses lead and any iron sulfides present by selective surface oxidation, and also promotes copper and enhances its flotation rate. Various copper collectors in addition to the ethyl isopropyl thionocarbamate mentioned are useful, with the caveat that they retain selectivity in the acid environment present; copper collectors such as xanthates and dithiophosphates, for example, may promote considerable lead flotation with the copper. Generally, known collectors, frothers and other reagents are contemplated for use in the lead, copper and cobalt-nickel flotation circuits. Froth times in all circuits are varied as necessary to maximize recoveries. The use of lime to adjust the pH in the cobalt-nickel flotation circuit is not recommended, as this tends to increase viscosity and interfere with flotation.

The concentration conditions of the flotation circuits may be adjusted to the prevailing circumstances within broad limits. Generally, at least three cleaning stages are employed in each circuit, typically in a conventional countercurrent flow pattern. Tailings are cycled as necessary to optimize recovery of a particular mineral. Additional adaptations within the scope of the invention will be apparent to those skilled in the art.

EXAMPLES

Tables 2–4 summarize data on reagent suites and operational conditions for three pilot plant runs according to this invention.

Example I, (Table 2) Cycle test CT-3, Sample 2

TABLE 2

Cycle Test CT-3 Test Conditions
Pilot Plant Sample 2

| State | Reagents Added, Pounds/Ton $SO_2$ | M-1661[1] | $Na_2Cr_2O_7$ | $Ca(OH)_2$ | NaCN | AP-242[2] | AX-343[3] | MIBC[4] | Time, Minutes Grind | Cond | Froth | Pulp pH |
|---|---|---|---|---|---|---|---|---|---|---|---|---|
| Primary grind | 1.5 | | 0.20 | | | | | | 20 | | | |
| Aeration | 0.75 | | | | | | | | | 10 | | 6.5 |
| Cu rougher (1) | | 0.016 | | | | | | 0.01 | | 1 | 1.5 | 6.5 |
| (2) | 0.10 | | | | | | | | | 1 | 1.5 | 6.5 |
| Cu regrind | 0.20 | 0.008 | 0.10 | | | | | | 20 | | | |
| Cu 1st cleaner | 0.10 | 0.008 | | | | | | 0.005 | | 1 | 4 | 6.5 |
| Cu 2nd cleaner | 0.10 | | 0.05 | | | | | | | 1 | 3 | 6.5 |
| Cu 3rd cleaner | 0.10 | | 0.04 | | | | | | | 1 | 2 | 6.5 |
| Pb conditioning | | | | 1.0 | 0.30 | | | | | 10 | | 9.0 |
| Pb rougher | | | | | | 0.02 | 0.015 | 0.01 | | 1 | 3 | |
| Stage | Primary grind | | | Cu regrind | | | Rougher | | Cleaners | | | |
| Equipment | 5" × 12" batch mill | | | 5" × 7" pebble mill | | | 1000 g D-1 | | 250 g D-1 | | | |
| Speed (rpm) | 52 | | | 72 | | | | | | | | |
| % solids | 65 | | | | | | | | | | | |

| | Reagents Added, Pounds/Ton $Ca(OH)_2$ | NaCN | $Na_2SiO_3$ | AP-242[2] | AX-343[3] | $CuSO_4$ | MIBC[4] | Time, Minutes Grind | Cond | Froth | Pulp pH |
|---|---|---|---|---|---|---|---|---|---|---|---|
| Pb 1st cleaner | 0.10 | 0.05 | 0.05 | 0.01 | | | | | 1 | 2 | 9.5 |
| Pb 2nd cleaner | 0.05 | 0.025 | 0.025 | | | | | | 1 | 2 | |
| Pb 3rd cleaner | 0.05 | 0.025 | 0.025 | | | | | | 1 | 1 | |
| Pb 4th cleaner | 0.05 | 0.025 | 0.025 | | | | | | 1 | 1 | |
| Co, Ni conditioning | | | | | | 0.6 | | | 5 | | 8.2 |
| Co, Ni rougher (1) | | | | | 0.05 | | | | 1 | 4 | |
| (2) | | | | | 0.05 | 0.2 | | | 2 | 4 | 8.0 |
| Co, Ni 1st cleaner | | | | | 0.01 | | | | 1 | 4 | 7.7 |
| Co, Ni 2nd cleaner | | | | | 0.01 | | | | 1 | 3 | 7.9 |
| Co, Ni 3rd cleaner | | | | | 0.01 | | | | 1 | 2 | 7.9 |
| Stage | Roughers | | | Co, Ni 1st cleaner | | | Remaining cleaners | | | | |

TABLE 2-continued

Cycle Test CT-3 Test Conditions
Pilot Plant Sample 2

| Equipment | 1000 g D-1 | 500 g D-1 | 250 g D-1 |
|---|---|---|---|

[1]Ethyl isopropyl thionocarbamate
[2]Ammonium diisopropyl dithiophosphate
[3]Sodium isopropyl xanthate
[4]Methyl isobutyl carbinol Example II (Table 3) Cycle Test CT-4, Sample 3

TABLE 3

Cycle Test CT-4 Test Conditions
Pilot Plant Sample 3

| | Reagents Added, Pounds/Ton | | | | | | | | Time, Minutes | | | Pulp |
|---|---|---|---|---|---|---|---|---|---|---|---|---|
| Stage | $SO_2$ | M-1661[1] | $Na_2Cr_2O_7$ | $Ca(OH)_2$ | NaCN | AP-242[2] | AX-343[3] | MIBC[4] | Grind | Cond | Froth | pH |
| Primary grind | 1.0 | | 0.2 | | | | | | 26 | | | |
| Aeration | 0.70 | | | | | | | | | 10 | | 6.5 |
| Cu rougher (1) | | 0.024 | | | | | | 0.016 | | 1 | 2 | |
| (2) | | 0.008 | | | | | | | | | 2 | 6.7 |
| Cu regrind | 0.10 | | 0.1 | | | | | | 12 | | | |
| Cu 1st cleaner (1) | 0.10 | 0.008 | | | | | | | | 1 | 2 | 6.3 |
| (2) | | 0.008 | | | | | | | | 1 | 2 | |
| Cu 2nd cleaner | 0.10 | | 0.05 | | | | | | | 1 | 3 | |
| Cu 3rd cleaner | 0.06 | | 0.04 | | | | | | | | 2 | |
| Pb conditioning | | | | 0.8 | 0.3 | | | | | 10 | | 8.5 |
| Pb rougher | | | | | | 0.02 | 0.015 | | | 1 | 3 | |
| Stage | Primary grind | | | Cu regrind | | | Roughers | | Cleaners | | | |
| Equipment | 5" × 12" batch mill | | | 5" × 7" pebble mill | | | 1000 g D-1 | | 250 g D-1 | | | |
| Speed (rpm) | 52 | | | 72 | | | | | | | | |
| % solids | 65 | | | 50 | | | | | | | | |

| | Reagents Added, Pounds/Ton | | | | | | | Time, Minutes | | | Pulp |
|---|---|---|---|---|---|---|---|---|---|---|---|
| | $Ca(OH)_2$ | NaCN | $Na_2SiO_3$ | AP-242[2] | AX-350[5] | $CuSO_4$ | MIBC[4] | Grind | Cond | Froth | pH |
| Pb 1st cleaner | 0.05 | 0.05 | 0.05 | 0.01 | | | | | 1 | 2 | 9.5 |
| Pb 2nd cleaner | 0.02 | 0.025 | 0.025 | | | | | | 1 | 2 | |
| Pb 3rd cleaner | 0.01 | 0.025 | 0.025 | | | | | | 1 | 1 | |
| Pb 4th cleaner | 0.01 | 0.025 | 0.025 | | | | | | 1 | 1 | 9.5 |
| Co, Ni conditioning | | | | | | 0.6 | | | 5 | | |
| Co, Ni rougher (1) | | | | | 0.05 | | | | 1 | 4 | 8.0 |
| (2) | | | | | 0.05 | 0.2 | | | 2 | 4 | |
| Co, Ni 1st cleaner | | | | | 0.01 | | | | 1 | 4 | 8.0 |
| Co, Ni 2nd cleaner | | | | | 0.01 | | | | 1 | 3 | |
| Co, Ni 3rd cleaner | | | | | 0.01 | | | | 1 | 2 | |
| Stage | Roughers | | | Co, Ni 1st cleaner | | | Other cleaners | | | | |
| Equipment | 1000 g D-1 | | | 500 g D-1 | | | 250 g D-1 | | | | |
| Speed | 1600 | | | 1300 | | | 1100 | | | | |

[1]Ethyl isopropyl thionocarbamate
[2]Ammonium diisopropyl dithiophosphate
[3]Sodium isopropyl xanthate
[4]Methyl isobutyl carbinol
[5]Potassium amyl xanthate Example III (Table 4) Cycle Test CT-5, Sample 5

TABLE 4

Cycle Test CT-5 Test Conditions
Pilot Plant Sample 5

| | Reagents Added, Pounds/Ton | | | | | | | | Time, Minutes | | | Pulp |
|---|---|---|---|---|---|---|---|---|---|---|---|---|
| Stage | $SO_2$ | M-1661[1] | $Na_2Cr_2O_7$ | $Ca(OH)_2$ | NaCN | AP-242[2] | AX-343[3] | MIBC[4] | Grind | Cond | Froth | pH |
| Primary grind | 1.0 | | 0.2 | | | | | | 26 | | | |
| Aeration | 0.80 | | | | | | | | | 10 | | 6. |
| Cu rougher (1) | | 0.024 | | | | | | 0.01 | | 1 | 2 | |
| (2) | | 0.008 | | | | | | | | 1 | 2 | |
| Cu regrind | 0.1 | | 0.1 | | | | | | 17 | | | |
| Cu 1st cleaner (1) | 0.06 | 0.016 | | | | | | 0.01 | | 1 | 2 | 6. |
| (2) | | 0.008 | | | | | | | | 1 | 3 | |
| Cu 2nd cleaner | 0.12 | | 0.05 | | | | | | | 1 | 3.5 | 6. |
| Cu 3rd cleaner | 0.06 | | 0.04 | | | | | | | 1 | 2.5 | 6. |
| Pb conditioning | | | | 0.5 | 0.3 | | | | | 10 | | 8. |
| Pb rougher | | | | | | 0.02 | 0.015 | 0.01 | | 1 | 3 | 8. |
| Stage | Primary grind | | | Regrind | | | Rougher | Cleaners | | | | |
| Equipment | 5" × 12" batch mill | | | 5" × 7" pebble mill | | | 1000 g D-1 | 250 g D-1 | | | | |
| Speed (rpm) | 52 | | | 72 | | | 1800 | 1200 | | | | |
| % solids | 65 | | | | | | | | | | | |

| | Reagents Added, Pounds/Ton | Time, Minutes | Pulp |
|---|---|---|---|

TABLE 4-continued

Cycle Test CT-5 Test Conditions
Pilot Plant Sample 5

| | $Ca(OH)_2$ | NaCN | $Na_2SiO_3$ | AP-242[2] | AX-350[5] | $CuSO_4$ | MIBC[4] | Grind | Cond | Froth | pH |
|---|---|---|---|---|---|---|---|---|---|---|---|
| Pb 1st cleaner | 0.10 | 0.05 | 0.05 | 0.01 | | | | | 1 | 2 | 9.5 |
| Pb 2nd cleaner | 0.05 | 0.025 | 0.025 | | | | | | 1 | 2 | |
| Pb 3rd cleaner | 0.05 | 0.025 | 0.025 | | | | | | 1 | 1 | |
| Pb 4th cleaner | 0.05 | 0.025 | 0.025 | | | | | | 1 | 1 | 9.5 |
| Co, Ni conditioning | | | | | | 0.5 | | | 5 | | 8.5 |
| Co, Ni rougher (1) | | | | | 0.05 | | | | 1 | 4 | 8.5 |
| (2) | | | | | 0.05 | 0.2 | | | 2 | 4 | |
| Co, Ni 1st cleaner | | | | | 0.01 | | | | 1 | 4 | 8.0 |
| Co, Ni 2nd cleaner | | | | | 0.01 | | | | 1 | 3 | |
| Co, Ni 3rd cleaner | | | | | 0.01 | | | | 1 | 2 | |
| Stage | Rougher | | | Co, Ni 1st cleaner | | | Remaining cleaners | | | | |
| Equipment | 1000 g D-1 | | | 500 g D-1 | | | 250 g D-1 | | | | |
| Speed (rpm) | 1800 | | | 1500 | | | 1200 | | | | |

[1]Ethyl isopropyl thionocarbamate
[2]Ammonium diisopropyl dithiophosphate
[3]Sodium isopropyl xanthate
[4]Methyl isobutyl carbinol
[5]Potassium amyl xanthate Example IV-Table 5 summarizes the results obtained from cycle testing according to Examples I, II and III. As much as 91% of the copper, 85% of the lead and 92% of the cobalt and nickel values were recovered in their respective concentrates. Cycle tests were not conducted on Samples 1 and 4. A primary grind of 60 to 70% passing 200 mesh was employed. Thickening and filtration rates of the products were judged adequate to good.

TABLE 5

| Product | Weight % | Assays, % Cu | Pb | Co | Ni | Distribution, % Cu | Pb | Co | Ni |
|---|---|---|---|---|---|---|---|---|---|
| Sample No. 2 | | | | | | | | | |
| Cu conc | 2.51 | 28.6 | 4.68 | 0.19 | 0.27 | 89.0 | 11.6 | 3.3 | 3.0 |
| Pb conc | 1.01 | 0.84 | 79.2 | 0.14 | 0.18 | 1.0 | 78.9 | 1.0 | 0.8 |
| Co—Ni conc | 3.24 | 1.16 | 1.05 | 3.80 | 5.85 | 4.7 | 3.4 | 86.1 | 82.5 |
| Head (calc) | — | 0.81 | 1.01 | 0.143 | 0.23 | — | — | — | — |
| Sample No. 3 | | | | | | | | | |
| Cu conc | 3.25 | 27.6 | 4.75 | 0.23 | 0.32 | 89.0 | 9.1 | 4.2 | 4.0 |
| Pb conc | 1.70 | 0.30 | 84.8 | 0.11 | 0.15 | 0.5 | 85.0 | 1.1 | 1.0 |
| Co—Ni conc | 5.38 | 1.17 | 0.91 | 2.70 | 3.85 | 6.2 | 2.9 | 81.2 | 80.4 |
| Head (calc) | — | 1.01 | 1.69 | 0.179 | 0.26 | — | — | — | — |
| Sample No. 5 | | | | | | | | | |
| Cu conc | 6.84 | 31.2 | 2.32 | 0.25 | 0.32 | 90.9 | 10.5 | 3.2 | 3.2 |
| Pb conc | 1.64 | 0.56 | 78.6 | 0.28 | 0.38 | 0.4 | 85.1 | 0.9 | 0.9 |
| Co—Ni conc | 5.95 | 2.59 | 0.62 | 8.30 | 10.6 | 6.5 | 2.4 | 92.4 | 91.7 |
| Head (calc) | — | 2.35 | 1.51 | 0.53 | 0.69 | — | — | — | — |

What is claimed is:

1. In a sequential flotation process for the separation of components of a mineral mixture of the type wherein a primary grind ore pulp is routed sequentially through a series of flotation circuits having successive separation and concentration stages for separating and concentrating one of the mineral components, the improvement comprising:

grinding a sulfide ore comprising a mixture of copper, lead and cobalt-nickel sulfide minerals in a carbonate matrix to provide a primary grind flotation pulp;

conditioning the pulp with $SO_2$ under intense aeration to depress lead and cobalt-nickel and promote copper;

routing the conditioned pulp to a copper flotation circuit having a roughing stage and at least one cleaning stage;

effecting flotation of the copper and separating a copper rougher concentrate from a copper rougher tailing product;

regrinding the copper rougher concentrate to liberate lead and cobalt-nickel minerals and conditioning the reground concentrate with $SO_2$;

cleaning the reground conditioned rougher concentrate and separating a first copper cleaner concentrate from a first copper cleaner tailing product;

routing at least the copper rougher tailing product directly to the lead flotation circuit wherein a lead concentrate is separated from a lead tailing product;

routing the lead tailing product from the lead flotation circuit to a cobalt-nickel flotation circuit wherein a cobalt-nickel concentrate is separated from a cobalt-nickel tailing product; and recovering the copper, lead and cobalt-nickel concentrates from their respective flotation circuits.

2. The invention of claim 1, wherein the copper rougher tailing product and first copper cleaner tailing product are combined and routed to the lead flotation circuit.

3. The invention of claim 1, wherein flotation of copper is effected in the absence of pH modifiers other than sulfur dioxide or sulfurous acid.

4. The invention of claim 1, wherein the primary grind pulp is conditioned by addition of $SO_2$ in an amount of from about 1 to about 5 lbs. $SO_2$ per ton of pulp.

5. The invention of claim 1, wherein the primary grind pulp is intensely aerated by injection of natural air into the pulp at a rate of about 3 to 5 cu ft/min.

6. The invention of claim 1, wherein lead is separated by flotation after depression of other sulfides present with a cyanide.

7. The invention of claim 1, wherein cobalt/nickel is separated by flotation after activation with copper sulfate.

8. The invention of claim 1, wherein the sulfide ore is a Missouri lead belt ore.

9. The invention of claim 1, wherein the sulfide ore is a viburnam trend ore body of the new lead belt.

10. The invention of claim 1, wherein the sulfide ore is located within a Mississippi Valley-type deposit.

11. The invention of claim 1, wherein the flotation of copper is effected at an acidic pH of about 6.5 to 6.8.

12. The invention of claim 11, wherein a collector highly preferential for copper in an acidic medium is employed for copper flotation.

13. The invention of claim 11, wherein the collector is ethyl isopropyl thionocarbamate.

* * * * *